US005623748A

United States Patent [19]

Bacchio

[11] Patent Number: 5,623,748

[45] Date of Patent: Apr. 29, 1997

[54] SYSTEM FOR CARDING TEXTILE FIBRES

[75] Inventor: Giovanni Bacchio, Mongrando, Italy

[73] Assignee: Fonderie Officine Riunite F.O.R., Beilla (Vercelli), Italy

[21] Appl. No.: 588,044

[22] Filed: Jan. 22, 1996

[30] Foreign Application Priority Data

Jan. 26, 1995 [IT] Italy ..... TO95A0050

[51] Int. Cl.[6] ..... D01G 15/00

[52] U.S. Cl. ..... 19/98; 19/163; 28/101; 28/107

[58] Field of Search ..... 19/98, 99, 144, 19/145.7, 296, 161.1, 160, 163, 65 A, 145.5; 28/101, 107, 115

[56] References Cited

U.S. PATENT DOCUMENTS

| | | | |
|---|---|---|---|
| 3,112,548 | 12/1963 | Smith II | 28/115 |
| 3,670,485 | 6/1972 | Brown et al. | 19/145.7 |
| 3,682,734 | 8/1972 | Burger | 19/163 |
| 3,940,532 | 2/1976 | Smith II | 28/115 |
| 4,199,644 | 4/1980 | Platt | 28/107 |
| 4,416,936 | 11/1983 | Erickson et al. | 28/107 |
| 5,018,255 | 5/1991 | Bolliand | 28/107 |
| 5,060,347 | 10/1991 | Beckers | 19/163 |
| 5,182,835 | 2/1993 | De'Giudici | 19/163 |
| 5,205,018 | 4/1993 | Leifeld et al. | 19/145.5 |

FOREIGN PATENT DOCUMENTS

| | | |
|---|---|---|
| 1940699 | 3/1971 | Germany . |
| 4234354 | 4/1994 | Germany . |
| WO9204492 | 3/1992 | WIPO . |
| WO9315247 | 8/1993 | WIPO . |

*Primary Examiner*—Michael A. Neas

*Attorney, Agent, or Firm*—Sughrue, Mion, Zinn, Macpeak & Seas

[57] ABSTRACT

A system for carding textile fibres comprises first and second carding machines and a layering system disposed between the output portion of the first carding machine and the input portion of the second carding machine. The layering system forms a mat composed of a plurality of superimposed layers produced from the web of fibres coming from the first carding machine. The system comprises a compactor device disposed downstream of the layering system for bringing about cohesion of the various superimposed layers forming the mat.

6 Claims, 2 Drawing Sheets

SYSTEM FOR CARDING TEXTILE FIBRES

BACKGROUND OF THE INVENTION

The present invention relates to a system for carding textile fibres.

The basic purpose of carding operations consists of dividing the flock of fibres into a uniform layer in which the fibres are separated, straightened and spread out in a single direction. The production of a web with a uniform distribution of fibres, with fibres which are sufficiently straight and with a uniform appearance and mixture of colours generally requires a system composed of many complex and large machines.

In particular, in some carding areas, it is necessary to have two or more carding machines in series with one another, between which there is a device which mixes the fibres to be supplied to the second carding machine in order to reduce errors due to a non-uniform distribution of the fibres both longitudinally and transversely in the web emerging from the first carding machine.

A typical method of mixing the fibres between the first and second carding machines consists of the provision of a layering device which forms a sliver composed of a plurality of superimposed layers produced from the web of fibres coming from the first carding machine. The sliver formed by the layering device is supplied to the second carding machine by means of a series of conveyors which change the arrangement and the orientation of the fibres supplying the second carding machine. The layering device and the conveyor constitute a layering system which can form a mat of fibres for supply to the second carding machine.

A problem which arises in carding systems with two carding machines in series with one another and a layering system interposed between the two carding machines is that the behaviour of the layered mat when it enters the second carding machine is unpredictable and non-uniform. There is a tendency to generate a non-uniform and repetitive distribution of fibres on the members of the carding machine in the second carding machine, and this involves the need to use a very complex carding machine having a large number of carding members with several drums to make up for the errors and the non-uniform distribution of the fibres.

In particular, a defect which occurs especially when the orientation of the fibres at the input of the second carding machine is predominantly transverse the direction of advance of the mat consists of the fact that "lumps" or tufts of fibres are torn from the supply sliver at the input to the second carding machine and give rise to irregular formations of fibres known as "flashing" on the carding drums. To eliminate these defects, it is necessary to subject the web to successive passes through carding cylinders and drums and, as well as increasing the complexity of the carding machines, this involves an increase in the time spent by the fibres inside the carding machine which increases the danger of damage to the fibres due to shortening thereof which causes severe depreciation of the most valuable fibres.

SUMMARY OF THE INVENTION

The object of the present invention is to provide a system for carding textile fibres which is not affected by the aforementioned problems.

According to the present invention, this object is achieved by arranging a compactor device downstream of the layering system to bring about cohesion of the various superimposed layers forming the mat which supplies the second carding machine.

The fact that the various layers are rendered cohesive enables the second carding machine to be supplied with a mat composed of webs lightly bound together. The greater compactness of the mat at the input of the second carding machine causes the fibres to be drawn in more uniformly and considerably reduces defects due to non-uniform distribution of the fibres on the carding members. The system according to the present invention consequently enables the size and complexity of the second carding machine to be reduced with a consequent reduction in the time spent by the fibres inside the carding machine, which involves a significant improvement in the quality of the product obtained.

Amongst the various possible methods of bringing about cohesion of the mat, an advantageous method consists of providing a plurality of needles which form a series of perforations in the sliver during its transfer from the first carding machine to the second.

BRIEF DESCRIPTION OF THE DRAWINGS

Further characteristics and advantages of the present invention will become clear in the course of the detailed description which follows, given purely by way of non-limiting example, with reference to the appended drawings, in which.

DETAILED DESCRIPTION OF THE INVENTION

Figure 1:
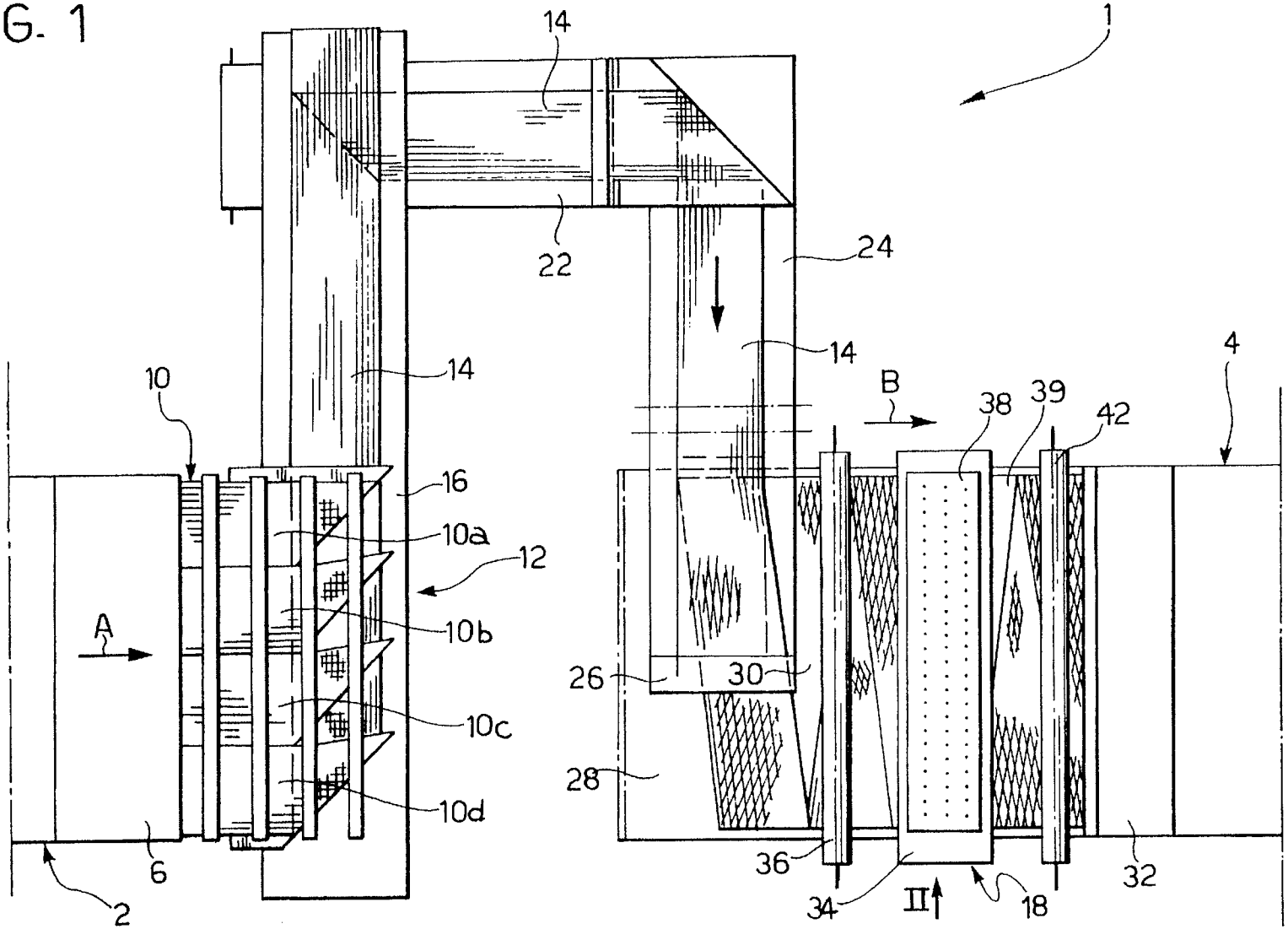
FIG. 1 is a schematic plan view showing a system according to the present invention.

FIG. 1 shows schematically a carding system comprising a first carding machine 2 and a second carding machine 4 arranged in series. The carding machines 2, 4 may be of any known type and have been shown only schematically since their structure falls outside the scope of the present invention. The output portion of the first carding machine 2, from which a web of fibres 10 emerges in the direction indicated by the arrow A, is indicated 6.

Between the carding machines 2, 4, there is a fibre-layering and -orienting system, generally indicated 1, which carries out the series of steps described below. The system 1 comprises a layering device 12, a series of conveyor belts 16, 22, 24 and a lapper 26.

The layering device 12 is disposed at the output of the first carding machine 2 and forms, from the web 10, a sliver 14 composed of a plurality of superimposed layers. FIG. 1 shows a particular type of layering device which forms the sliver 14 by dividing the web 10 longitudinally into a plurality of portions 10*a*, 10*b*, 10*c*, 10*d* which are folded through 90° from the direction in which they are supplied and are superimposed on one another on the first conveyor belt 16. This particular type of layering device is described in detail in U.S. Pat. No. 2,713,182.

It must, however, be underlined, that the type of layering device used is not critical for the purposes of the present invention. Instead of the device shown by way of example in FIG. 1, it is possible to use a layering device of a different type such as, for example, a lapper which folds the web 10 successively or, in general, any other device which can form, from the web 10 coming from the output portion 6 of the first carding machine 2, a sliver constituted by a plurality of layers of textile fibres superimposed on one another.

The sliver 14 produced by the layering device 12 is transported by the series of conveyor belts 16, 22 and 24 until it reaches the lapper 26 which spreads out the sliver 14 on a conveyor belt 28 so as to form a mat 30. The series of transmission elements for the sliver 14*a* shown in FIG. 1 result solely from the fact that, for reasons of space, the two carding machines 2, 4 are aligned with one another. In general, the transfer path of the sliver 14*a* could be of any shape according to the relative positions of the two carding machines.

The mat 30 produced by the layering system 1 advances in the direction indicated by the arrow B and passes through a compacting device 18. The device 18 has the purpose of bringing about cohesion of the various superimposed layers forming the mat 30. A cohesive mat 39 which has modified mechanical characteristics in comparison with the mat 30 and is much more suitable for subsequent admission to the second carding machine 4 is obtained at the output of the compactor device 18.

One of the possible systems for bringing about the cohesion of the mat 30 will be described below. The following description is intended purely as an example, since the scope of the present invention is intended to include any system which enables both the orientation and layering of the fibres of the web 10 of the carding machine 2 and the partial compacting of the mat 30 to be coordinated in a suitable manner so as to transform and optimize the mechanical characteristics of the mat 39 and render them more suitable for admission to the carding machine 4.

Figure 2:
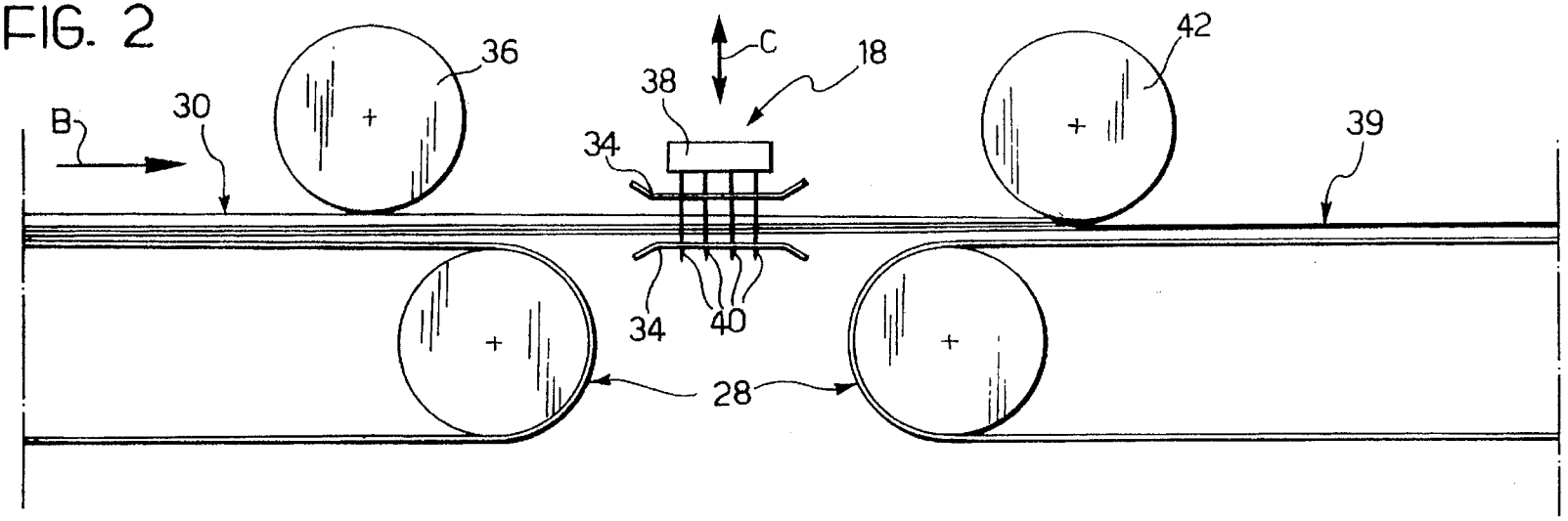
FIG. 2 is a schematic side view of the compactor device taken on the arrow II of FIG. 1.

With reference to FIG. 2, the compacting device 18 comprises a pair of stationary and parallel perforated plates 34 between which the mat 30 constituted by a series of layers, of which there are four in the embodiment illustrated, is advanced. Before being admitted between the plates 34, the mat 30 is compressed by means of a compacting drum 36. The cohesion of the mat 30 is brought about by means of a movable head 38 with a plurality of needles 40 which extend through the perforations in the plates 34.

The needle-holder head 38 performs a reciprocating motion in the directions indicated by the double arrow C in FIG. 2. The frequency of the movement of the head 38 is determined according to the speed of advance of the mat 30 and depends upon the degree of cohesion to be achieved.

At the output of the plates 34, the coherent mat 39 is further compressed by a second compactor drum 42.

Figure 3:
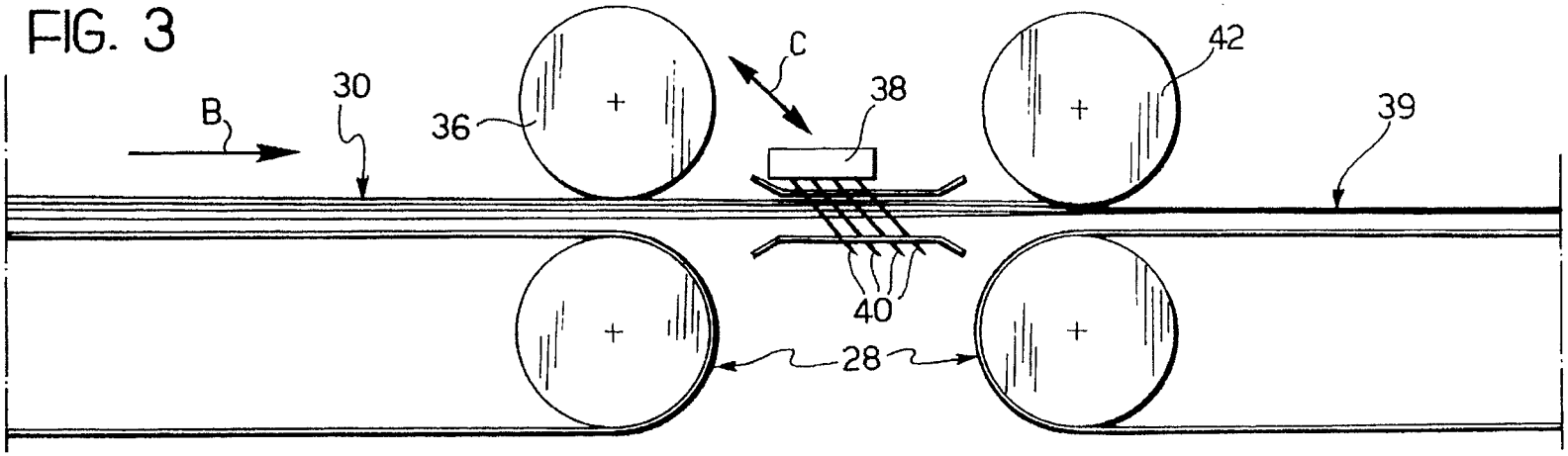
FIG. 3 is a side view showing a variant of the compactor device according to the present invention.

FIG. 3 shows a variant of the needle compacting device 18 which enables the speed of advance of the mat 30 to be increased. In the variant of FIG. 3, the needles 40 are inclined at an acute angle to the direction in which the mat 30 is supplied and this facilitates the disengagement of the needles 40 from the mat even when it is moving at high speed. The direction of the reciprocating movement C of the head 38 is also inclined like the needles 40.

As stated, the needle system for bringing about cohesion constitutes only a preferred embodiment of the present invention. Alternatively, other devices could be used, such as, for example, a pair of contra-rotating drums which have needles or nails and between which the mat 30 is passed. This achieves a Uniform supply to the second carding machine 4 and prevents defects due to the tearing of tufts or lumps of fibres from the mat 39 supplying the second carding machine 4, and the mat 30 is subjected to a step to bring about cohesion with partial interpenetration of the layers downstream of the layering system 1.

What is claimed is:

1. A system for carding textile fibres comprising:

a first and a second carding machine, the first carding machine having an output portion and the second carding machine having an input portion, a layering system disposed between said output portion and input portion, the layering system being able to form a mat composed of a plurality of superimposed layers produced from a web of fibres coming from the first carding machine, and a compactor device disposed downstream of the layering system for bringing about cohesion of the various superimposed layers forming the mat.

2. A system according to claim 1, wherein the compactor device comprises a head which can move with reciprocating motion and carries a plurality of needles which form a series of perforations in the mat during its transfer to the second carding machine.

3. A system according to claim 2, wherein the needles are inclined to the mat at an acute angle to a direction in which the mat is supplied.

4. A system according to claim 2, wherein the compactor device comprises a pair of parallel and stationary plates between which the mat passes, and which have holes for the passage of the needles.

5. A system according to claim 4, further comprising a compactor drum which compresses the mat immediately upstream of the input to the plates.

6. A system according to claim 5, further comprising a second compactor drum disposed immediately downstream of the output of the plates.

* * * * *